US006038904A

United States Patent [19]

Barnes

[11] Patent Number: 6,038,904

[45] Date of Patent: Mar. 21, 2000

[54] DECAMBERER

[76] Inventor: Austen Barnes, 3407 Holborn Road, R.R.2 Queensville, Ontario, Canada, L0G 1R0

[21] Appl. No.: 09/226,601

[22] Filed: Jan. 7, 1999

[51] Int. Cl.[7] ..... B21B 13/08

[52] U.S. Cl. ..... 72/234; 72/226; 72/160

[58] Field of Search ..... 72/160, 161, 162, 72/203, 224, 226, 234, 241.6, 252.5, 365.2

[56] References Cited

U.S. PATENT DOCUMENTS 3,006,401 10/1961 Wognum et al. ..... 72/162
3,438,231 4/1969 Petzschke ..... 72/160
3,854,315 12/1974 Winkler ..... 72/224
5,218,848 6/1993 Takakura et al. ..... 72/161

FOREIGN PATENT DOCUMENTS 2817900 10/1979 Germany ..... 72/160

*Primary Examiner*—Ed Tolan

[57] ABSTRACT

A decamberer for strip of approximate rectangular section has opposed rollers defining a downstream extent each with grooves receiving the strip edges and maintaining the strip in an approximate plane, and defining when viewed perpendicular to the plane an undulatory shape and with a progressively decreasing amplitude of oscillation.

15 Claims, 3 Drawing Sheets

DECAMBERER

This invention relates to means and a method for effectively decambering narrow continuous strip products of the type having a rectangular cross-section. The flat strip may be thought of as defining a median plane corresponding to a unit of its length and of its wide dimension and a second plane also parallel to the longitudinal extent of the strip and perpendicular to the first. The rectangular strip is flattened by flattening rollers across the width. This is established practice and is common. However, flattening in the other plane, i.e. side to side straightening is very difficult in some cases, prior to this invention it was impossible.

A recurring problem exists in effectively decambering narrow continuous strip materials, other than round wire. Round wire is easily straightened in all planes by rotary machines. Flat wire or narrow flat strip is successfully flattened by flattening rolls applied to the faces across the width. This is established practice and is common.

However, flattening applied to the other plane, i.e. side to side straightening, is very difficult. In many cases, prior to this invention, it was impossible.

Narrow strip is often produced by slitting larger width coils. The slitting knives slightly extrude the material adjacent to the slit, as that the inner slit edges of strips, or mults, are usually longer than the outer edges. This means that the strip bends outward from the slit edges, which is typical of slitting generated camber. The camber may be consistent throughout a given coil, or it may vary in amount and direction. The decambering machine must correct all types of camber.

Often in production processes, such as in sawblade production or bimetallic thermostatic strip production, a thin strip of different material is welded to the first strip, and the welded strip has to be softened after welding by annealing before being capable of further processing. The annealing causes the strip to "relax" and it often emerges from the annealing oven with severe local irregular side to side bending deformities in alternate directions. This is extremely difficult to correct along with the camber; in fact prior to this invention it was impossible to decamber this type of material.

It is an object of the machine described herein to correct substantially all types of camber problems in narrow strip.

Early attempts in the industry at decambering strip, treated the side to side curvature as a flattening problem, and alternating rolls were applied to the edge exactly as commonly applied to the faces across the width described above. The objective was to impact a deflection in the material greater than any already present, then remove it by diminishing sinusoidal deflection, exiting straight. This is shown in FIG. 1. The material is severely deflected after entering at left, then "snaked" in diminishing deflections exiting at right. Note, that with the ungrooved rolls used, the material tends to fold over or buckle at the roll locations, avoiding the required path travel, and in severe cases the strip will acquire permanent edge damage.

Attempts at avoiding this buckling problem can be made by grooving the decambering rolls as in FIG. 2, using a grooved roll decambering as shown in FIG. 3.

If the grooves are made just slightly more than the material thickness, properly confining it at and near the edges, the material will not buckle at the rolls. However, it will now bend or buckle at the unconstrained free edge opposite each roll as shown. This is also unsatisfactory.

This invention, therefore, discloses means and a method for decambering continuous strips where the camber removed is from side to side; that is the strip is straightened as viewed perpendicular to the sides of the strip.

This invention provides opposed pairs of grooved rollers which receive the edges of the strip in mutually facing portions of the grooves. Such grooves are arranged in a downstream extent of the roller path wherein opposed pairs of grooved rollers are respectively placed along the strip path and shape it as undulating as viewed perpendicular to the faces of the strip. Initial amplitude of the undulations is formed larger than the transverse dimension between the outwardly facing peaks. The path downstream corresponds to a decreasing amplitude of undulations and with the decreasing amplitude the frequency may also be diminished. 'Frequency' in this context is inversely proportional to the path length between convex outward peaks along the path.

The strip must frequently be prepared for insertion on the undulating path described by reduction of the larger of the transverse distances between peaks. This preferably accomplished by grooved rollers which define an envelope of decreasing width, as encountered by rollers travelling downstream on the path. The envelope narrows from a width greater than the upstream distance transverse to the strip path, between strip convex outward peaks. The transverse width of the envelope decreases so that the transverse envelope width is nearly that of the strip and the downstream strip output of the envelope path provides the upstream input to the undulatory extent.

In the converging extent it is not required that the rollers be exactly opposed. However it is required in both paths that the rollers be substantially as close to each other along the path as mounting and the control mechanism allow. In the converging path the fact that the rollers are as close as practically possible which means that the rollers are substantially opposed along the path.

As noted above, control mechanisms are required for the rollers, since the roller positions (mainly adjusted transverse to the mean direction of the path, must be changed for different types of strip and different materials).

In drawings, which illustrate a preferred embodiment of the invention:

Figure 1:
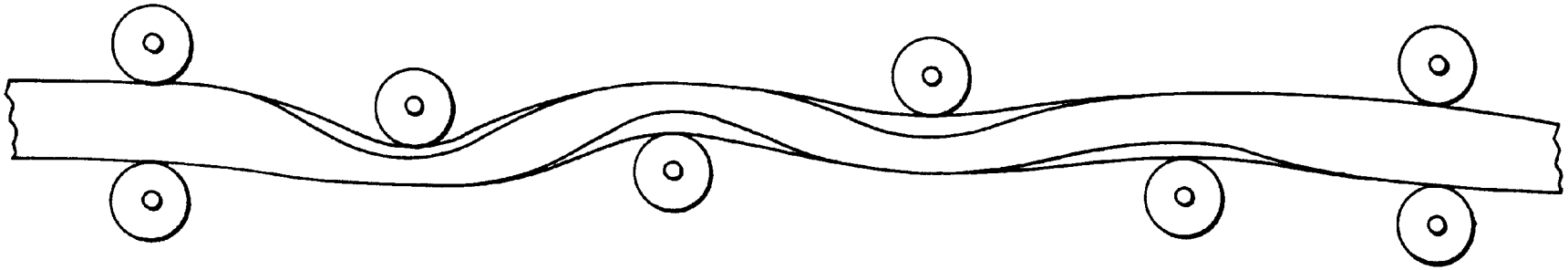
FIG.1 (PRIOR ART)
FIG. 1 shows a prior art decamberer line with ungrooved rolls
Figure 2:
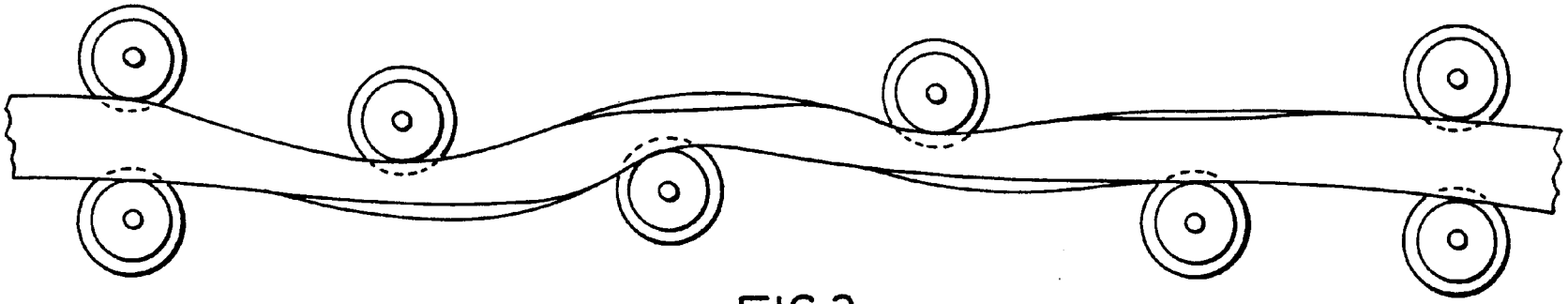
FIG.2 (PRIOR ART)
FIG. 2 shows a prior art decamberer line with grooved rolls
Figure 3:
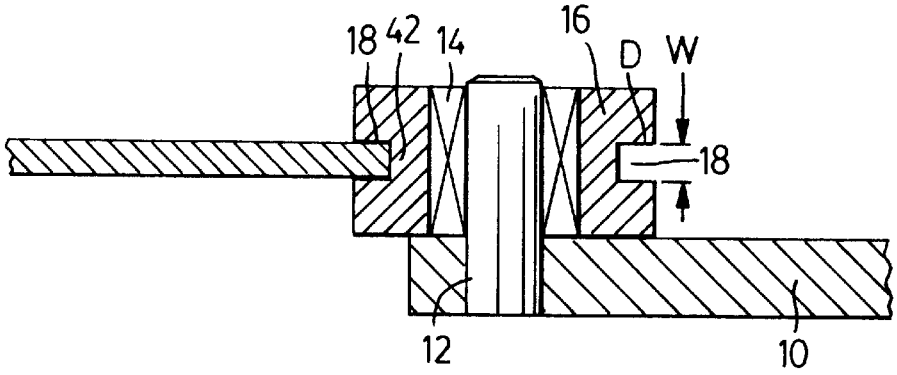
FIG. 3 shows an axial section of a constant grooved roller and portion of strip

In the drawings FIG. 3 shows a roller having a groove of fixed axial width having support are 10, shaft 12, bearing 14 and roller 16, defining groove 18 of width W measured perpendicular to the thickness of a strip in place therein and a depth D measured in the direction of the width of a strip therein.

Figure 4:
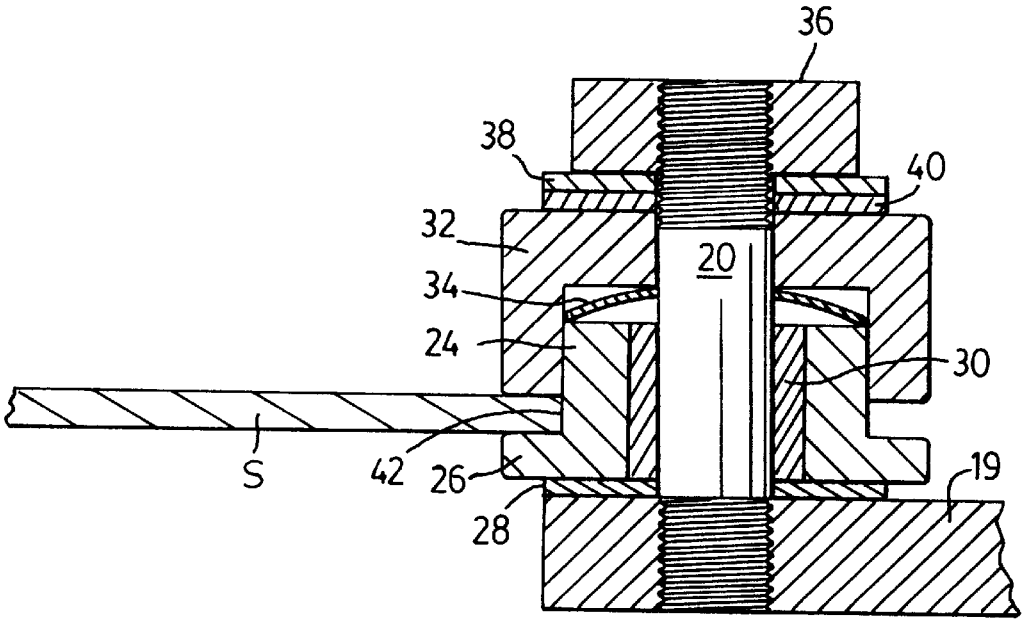
FIG. 4 shows a axial section of a roller with adjustable groove thickness in cooperative action with a strip edge.

In FIG. 4, a support arm 19 supports a shaft 20 having threaded external ends 22 U and 22 D. End 22 D is screwed into a threaded bore in arm 19. A roller 24 mounted on shaft 20 has a radial flange 26. At one end, the roller flange is related to the support arm 19 through a thrust bearing 28 and to the shaft by a needle bearing 30. A cap 32 is slidably related to the side wall of the shaft, and in a recess above the shaft a Belleville spring 34, (an annular convex upward resilient washer), surrounds the shaft and resiliently spaces the cap from the roller 24 end. A nut 36 and washer 38 on the other end of the shaft maintains a thrust bearing 40 in contact with the retainer cap. The adjustment of the nut 36 allows adjustment of the groove thickness to match that of the strips.

The rollers shown cooperate with similar opposed rollers (not shown). The rollers shown are idlers respectively but may be drive rollers. In other words the strip may be driven by the rollers or may drive the rollers upstream or downstream of the converging and the undulatory line.

Figure 5:
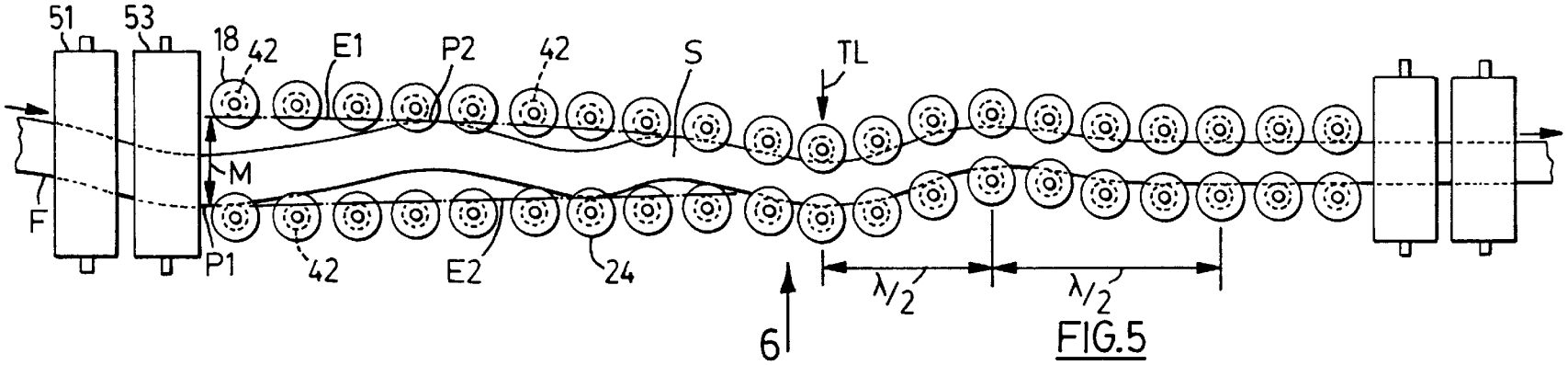
FIG. 5 is a plan view of a snake decambering line in accord with the invention; defining both the converging envelope and the undulating path
Figure 6:
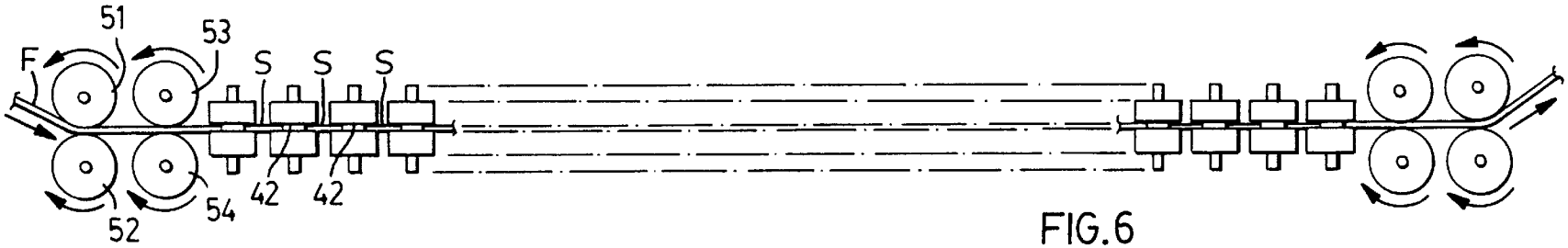
FIG. 6 is a side view of the members of FIG. 5.

FIG. 5 shows a line of opposed rollers 24 with rollers upstream and downstream from transition line TL. Upstream of the line TL the groove roots 42 in the rollers 24 define a converging envelope defined by lines E1 and E2 whose largest (entrance) transverse spacing M is larger than the maximum transverse distance between convex outward peaks P1 and P2 in the strips. As previously noted, the rollers are as close to each other in the strip travel direction as the diameter and controlled surroundings will allow.

Downstream of the converging envelope, i.e. downstream of line TL, the roller groove roots 42 define an undulatory path resembling a sinusoid. The rollers 24 in the undulatory path must be in opposed pairs to properly control the strip and the contour. The rollers 24 on each side of the strip downstream of line TL, must be as close to adjacent rollers as mounting and controls will allow. The undulatiig portion of the path defines two $\lambda/2$ sinusoidal lengths with the downstream $\lambda/2$ longer, symbolizing a decrease in frequency. The amplitude of the upstream $\lambda/2$ is larger than that of the downstream $\lambda/2$ as the sine wave resembles one subject to downing.

A pair of flatside roller pairs 51,52; 53,54 upstream from the convergence lines E1, E2 provide strips to enter the grooves 42 of the upstream pair of rollers 18. This is particularly useful if the feed of the flat wire side rollers is changing in height from when the feed is as an unwinding roller.

The arrangement downstream from the undulate rollers comprise pairs of rollers 55, 56:57, 58 along the now straight strip path. A pair of flat side rollers maintains the flatness of the strip against any changeable height in the extent G to the downstream equipment (coiler or the like).

I claim:

1. Decamberer for strip of approximate rectilinear section defining opposed sides and opposed edges, substantially opposed pairs of rollers defining a downstream extent for said strip, said opposed pairs of rollers being each provided with grooves shaped to slidably receive said strip edges, and to maintain adjacent strip in a substantial plane said substantially opposed rollers being arranged to define an undulating path as viewed perpendicular to said plane with a larger amplitude than that of the said strip viewed perpendicular to said plane entering the said downstream extent, said undulating path having progressively decreasing amplitude of undulation in the downstream direction therefrom, to a downstream end of approximately zero undulation amplitude.

2. Decamberer as claimed in claim 1, wherein said strip, before entering said downstream extent defines in said plane convex outwards peaks an upstream extent, where grooved rollers on the opposite sides of said strips the limits of an upstream strip path such upstream strip path limits tapering from an upstream end with greater transverse spacing than that of the convex outwards peaks, and said path limit tapers from said greater transverse spacing substantially to the strip width.

3. Decamberer as claimed in claim 1, where said rollers define a mean strip direction and wherein said rollers on said downstream extent are arranged in opposition in lines transverse to said mean strip direction.

4. Decamberer as claimed in claim 2, where said rollers define a mean strip direction and wherein said rollers on said downstream extent are arranged in opposition in lines transverse to said mean strip direction.

5. Decamberer as claimed in claim 1, wherein said rollers provide adjustable width grooves.

6. Decamberer as claimed in claim 2, wherein said rollers provide adjustable width grooves.

7. Decamberer as claimed in claim 1, wherein the upstream opposed grooved rollers define a strip extent where the plane of the strip is substantially perpendicular to the axes of the upstream opposed grooved rollers and there are opposed flat rollers substantially defining said plane, said opposed rollers guiding the strip into said plane upstream of the upstream grooved roller.

8. Decamberer as claimed in claim 2, wherein the upstream opposed grooved rollers define a strip extent where the plane of the strip is substantially perpendicular to the axes of the upstream opposed grooved rollers and there are opposed flat rollers rolling on opposite sides of said strip said opposed rollers guiding the strip into said plane upstream of the upstream grooved roller.

9. Decamberer as claimed in claim 1, wherein said undulating path defines a progressively decreasing frequency of undulation where there is progressively decreasing amplitude.

10. Decamberer as claimed in claim 2, wherein said undulating paths defines a progressively decreasing frequency of undulation where there is progressively decreasing amplitude.

11. Method of decambering longitudinally travelling strip defining a mean plane by its length and width, comprising passing said strip through a downstream extent between substantially opposed pairs of grooved rollers which roll while receiving in their respective grooves the edges of said strip where said rollers are arranged to create an undulating shape in said travelling strip as viewed perpendicular to said plane, the amplitude of undulations in said shape at the upstream end being greater than those in the untreated strip, the shape being arranged to cause said undulations to decrease in amplitude, in a downstream direction, so that the amplitude is substantially zero at the downstream end of said downstream extent.

12. Method of decambering strip as claimed in claim 11, wherein the frequency of said undulation in said shape decreases toward the downstream end.

13. Method of decambering strip as claimed in claim 11 including the step of passing said strip between two converging rows of grooved rollers, upstream of said undulating shape said two converging rows defining an the limits of the strip transverse in the travel direction, narrowing in a downstream direction from a transverse dimension greater than that between outward convex peaks in the untreated strip as seen said in said plane, to a width being substantially that of the strip and providing strip exiting the downstream end of the converging rows into the upstream end of the downstream extent.

14. Decamberer for strip of a approximate rectilinear section defining opposed sides and opposed edges, two lines of rollers respectively provided with grooves to receive said strip edges, said two lines defining a substantially planar downstream path for said strip, the rollers in said two lines arranged to define an undulating path for said strip when viewed perpendicular to said plane with a larger upstream amplitude than that of the strip when so viewed, said undulating path having a progressively decreasing amplitude in a downstream direction, reaching a downstream end of approximately zero amplitude where adjacent rollers in each line are as close as practically possible.

15. Decamberer for strip of approximate rectilinear section defining opposed sides and opposed edges, two lines of rollers respectively provided with grooves to receive said strip edges, defining a substantially planar upstream path for said strip, the rollers in said two lines defining the limits of a strip path, in the strip plane said limits tapering from an upstream end with greater transverse spacing than that of the convex outward spacing of peaks in said strip as viewed in said plane, wherein adjacent rollers in each line are as close as practically possible.

* * * * *